United States Patent [19]

Case

[11] 4,371,130

[45] Feb. 1, 1983

[54] YARN TUBE WITH UNIVERSAL PICKUP GROOVE

[75] Inventor: Manson D. Case, Hartsville, S.C.

[73] Assignee: Sonoco Products Company, Hartsville, S.C.

[21] Appl. No.: 224,674

[22] Filed: Jan. 13, 1981

[51] Int. Cl.[3] ..... B65H 75/28

[52] U.S. Cl. ..... 242/125.1; 242/18 PW

[58] Field of Search ..... 242/118.3, 118.32, 118.4, 242/118.7, 125–125.3, 18 PW; 24/73 SA, 73 AP, 73 PB, 115 R

[56] References Cited

U.S. PATENT DOCUMENTS

| | | |
|---|---|---|
| 2,262,665 | 11/1941 | Cavanaugh . |
| 2,793,822 | 5/1957 | Consoletti . |
| 3,103,305 | 9/1963 | Heatherly . |
| 3,326,494 | 6/1967 | Hartley, Jr. . |
| 3,451,639 | 6/1969 | Atwood et al. . |
| 3,625,451 | 12/1971 | Anderson . |
| 3,717,291 | 2/1973 | Adams et al. . |
| 3,767,129 | 10/1973 | Sobel . |
| 3,794,260 | 2/1974 | Sowell . |

FOREIGN PATENT DOCUMENTS

| | | | |
|---|---|---|---|
| 450855 | 4/1968 | Switzerland | 242/125.1 |
| 14997 | of 1906 | United Kingdom | 242/125.1 |

*Primary Examiner*—Leonard D. Christian

*Attorney, Agent, or Firm*—Dennison, Meserole, Pollack & Scheiner

[57] ABSTRACT

In a yarn tube having a yarn-supporting surface, a yarn-receiving pickup groove formed in the surface and extending circumferentially at least partially around the tube. The groove, specifically configured to accommodate both right hand and left hand yarn pickup, has a constant varying width along the length thereof, and either two widest sections or a common widest section capable of allowing "dropping in" and orientation of the yarn from both the right and left. Constantly narrowing sections extend outward from the widest section or sections to a common narrowest section or point to insure proper snagging of the yarn, initially received within the wide section or sections, regardless of the direction of rotation of the tube or the thickness of the yarn. The entire groove is of constant depth with the constant varying width insuring an accommodation and proper gripping of the yarn over a wide denier range.

7 Claims, 8 Drawing Figures

YARN TUBE WITH UNIVERSAL PICKUP GROOVE

RELATED APPLICATION

An application, Yarn Tube with Pickup Groove Accommodating Left Hand and Right Hand Pickup, in the name of William E. Bedenbaugh, and assigned to the same assignee as the present application, is directed to the environment of the present invention and sets forth distinct solutions to some of the same basic problems presently encountered in the field.

BACKGROUND OF THE INVENTION

This invention relates generally to yarn cores or tubes, and more particularly, to the pickup or start-up grooves provided therein.

The term "yarn" is used very broadly in the textile industry to describe long strings of fiber materials, such as Nylon, cotton, fiberglass, polyester, etc. These strings (yarn) are wound on tubes, cones, or the like, as a means for facilitating carrying the yarn from one textile process to another. The fully wound tubes are normally referred to as "yarn packages".

In the forming of a yarn package, the tube is placed on a yarn winder spindle which effects high speed rotation of the tube. As the yarn proceeds to the winder and is ready to be wound onto a tube, provision must be made for adhering the leading end of the yarn to the tube. This adherence is normally accomplished by means of a thin slit or groove in the tube surface which, through a wedging action, grips the leading portion of the yarn as it is moved over the groove in the rapidly rotating tube. This action of the groove in gripping the yarn is referred to as a "pickup".

After pickup, the tube continues its high speed rotation with the yarn wrapping therearound in multiple layers which extend along the length of the tube. Wrapping of the yarn in layers along the length of the tube is effected basically by a tube traversing mechanism which guides the yarn back and forth along the length of the rotating tube.

After winding a few layers about the tube, the gripping of the end section of the yarn by the groove is no longer required for the tube winding operation itself in that the initial few wraps of yarn provide a sufficient holding force for an effective continuation of the yarn winding operation. However, it is desirable that the groove effectively retain this leading end section of the yarn in that this end needs to be accessible for interconnection to the leading end of a following yarn package in subsequent operations wherein the yarn is fed from successive yarn packages in a continuous manner.

Heretofore, yarn pickup grooves have been designed to pick up a very limited denier range of yarn. In an attempt to increase the range of yarn sizes which can be accommodated by a particular groove, grooves with a wide lead-in section were devised. While such grooves have found wide commercial acceptance, they have one significant drawback in particular, the inability to pick up the yarn in both directions of rotation. Thus, depending on the direction of pickup which can be accommodated, the improved grooves are often referred to as right hand grooves or left hand grooves. The U.S. patent to J. M. Heatherly, No. 3,103,305, issued Sept. 10, 1963, refers to a typical single direction tube and specifically a tube with a right hand groove therein. Basically, looking from the left hand or ungrooved end of the tube in FIG. 1 of Heatherly, the wide section of the groove, that initially receiving the yarn for subsequent gripping within the narrow section, is to the right, thus requiring positioning of the tube on the spindle for rotation toward the right or clockwise, in conjunction with an introduction of the yarn, normally from the right side, in a manner so as to initially engage the wide section of the groove for a full, smooth reception therein and subsequent gripping engagement within the following narrow section.

In the actual winding operation, the empty tubes are normally placed in pairs on a winder spindle with the grooved ends of the tubes adjacent each other. This general arrangement, noted in the "prior art" illustration of FIG. 1, provides a convenient means for winding the yarn on two tubes simultaneously. Such an arrangement, as will be appreciated from FIG. 1, has heretofore required the adjacent ends of the two tubes to have, respectively, a left hand groove and a right hand groove.

The requirement for tubes with left hand grooves and tubes with right hand grooves gives rise to obvious inventory problems. In addition, there is a specific need to insure that the tubes have been properly oriented on the spindle for sequential pickup of the yarn on the two tubes.

In some instances, it has been proposed to provide similar grooves adjacent the opposite ends of each tube, providing in effect, a right hand groove at one end and a left hand groove at the other end. While such an arrangement would eliminate the necessity of stocking two different types of tubes, additional expense would be involved in the forming of two separate cuts or grooves in a single tube. Further, the problem of a proper orientation of the tubes on the spindles would still exist.

SUMMARY OF THE INVENTION

The present invention proposes a tube pickup groove specifically configured to both incorporate the advantages of a wide lead-in or drop-in section and also the ability to effect yarn pickup regardless of the direction of rotation of the tube or the side from which the yarn is introduced. In other words, the present invention proposes a groove wherein one of the specific functions thereof is to accommodate both right hand and left hand introduction of the thread to the tube. No prior art suggestion, insofar as is known, has ever proposed incorporation of the capabilities of both wide drop-in right hand grooves and wide drop-in left hand grooves in a single yarn pickup groove.

It is also proposed herein to enhance the accommodation of a wide range of yarn sizes through the provision of a groove wherein the width continuously varies throughout the length thereof.

In furtherance of the aims of the present invention, it is proposed that a single right hand-left hand pickup groove be configured to include a constantly varying width from one narrowest section outward to two opposed widest sections at the opposite ends thereof. The wide end sections allow for proper "drop" of even heavy denier yarn under conditions of both right hand and left hand introductions with rotation of the tube in either direction guiding and drawing the yarn along the narrowing groove until firm snagging or gripping of the yarn is achieved. The proposed groove, because of the combination of wide end receiving areas and a constantly narrowing gripping area, will accommodate a complete range of all yarn thickness capable of reception within the widest receiving areas, with proper gripping of the yarn being achieved regardless of the direction of the rotation of the tube. The ability of the groove to accommodate a range of yarn is further enhanced by forming the groove with a uniform depth and with the opposed walls thereof inwardly converging to provide a V-shaped configuration in cross-section.

As a further embodiment, the groove can be of a length whereby the opposed widest sections meet at a point diametrically opposed from the narrowest section. In this manner, a continuous groove will be formed about the tube, with the width of the groove constantly varying from the single common widest section or point to the single narrowest point or section in both directions of rotation.

Additional objects and advantages may become apparent from the following description of the details of construction and operation of the invention.

In each instance the illustrated size of the grooves has been enlarged for purposes of clarity.

DESCRIPTION OF THE PREFERRED EMBODIMENTS

Figure 1:
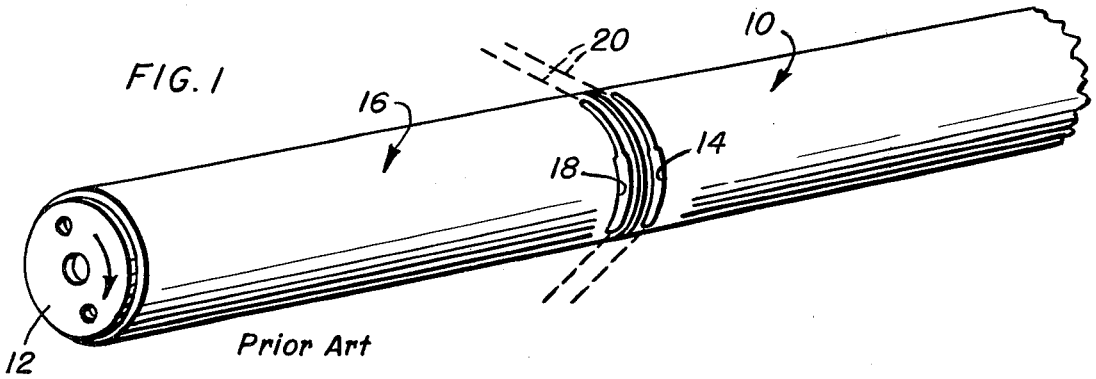
FIG. 1 is a schematic illustration of prior art tubes mounted in operative position on a winding spindle.
Figure 2:
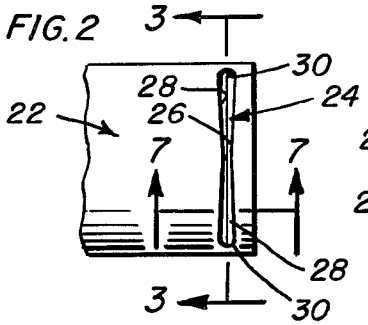
FIG. 2 illustrates one end of a tube grooved in accordance with the present invention.
Figure 3:
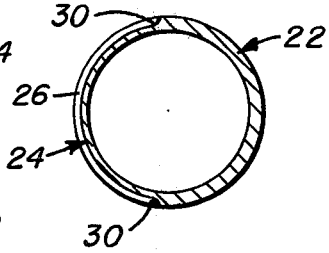
FIG. 3 is a transverse cross-sectional view taken substantially on line 3—3 of FIG. 2.

Referring now more specifically to the drawings, FIG. 1 illustrates a typical prior art installation wherein the inner tube 10, on a clockwise rotating spindle 12, is provided with a left hand groove 14, and the outer tube 16 is correspondingly provided with a right hand groove 18. In this manner, a proper accommodation is made for pickup of the yarn 20 on both tubes when introduced from the right side. As will be recognized, the tubes 10 and 16 must be loaded on the spindle 12 in the specific relationship illustrated if a proper pickup is to be achieved. This necessitates not only an inventory of both right and left hand tubes, but also the exercise of a substantial degree of care in positioning the tubes relative to each other on a common spindle.

The present invention, while retaining all of the advantages of the use of a large groove section for initial introduction of the yarn and a narrow section for an effective trapping or snagging of the yarn, avoids the necessity of two separate sets of tubes and any problems with regard to orientation of the tubes on the spindle. In addition, the provision of a constantly varying width contributes to a significant increase in the range of yarn denier which can be accommodated. For example, the tapering width can vary from wide points capable of accommodating the maximum thickness yarn to a narrow point capable of snagging the thinnest of yarns, thus also accommodating all yarns therebetween.

In furtherance of these aims, the tube of the present invention, herein designated by reference numeral 22, includes a startup or pickup groove 24 specifically configured to fully receive the yarn and effectively snag or grip the yarn regardless of the direction of rotation of the tube. In other words, the tube 22 of the present invention effectively functions both as a "right hand" tube and a "left hand" tube.

Structurally, the groove 24 includes a narrow central section or point 26. From this point 26 the groove, along the length thereof and throughout the full height or depth of the groove, widens symmetrically to the opposite sides thereof, into constantly tapering elongated sections 28 which terminate in maximum width opposed end sections or points 30. These end sections 30 in turn provide both left hand and right hand enlarged lead-in areas for the common central length of groove which constantly narrows from the opposed ends. It is contemplated that the width of the sections 28 at and adjacent the end points 30 be such as to allow for a "drop" or unencumbered reception of yarn having a substantial denier range. Incidentally, in referring to yarn denier, it is to be appreciated that this is a measure of the weight of yarn per unit length. Therefore, higher denier yarns normally are found to be bulkier and larger in diameter. It is the intention of the invention that the wider ends of the groove sections 28 accommodate, orientate and guide a wide range of yarn diameters with the actual snagging or gripping of the yarn occurring as the yarn moves into the narrowing sections toward the central point 26 of minimum width.

Figure 7:
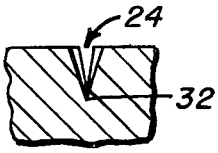
FIG. 7 is a cross-sectional detail taken substantially on line 7—7 in FIG. 2.

The provision for symmetrical continuous narrowing of the groove inwardly toward the center section or point 26, from the opposed end section or points 30 insures effective snagging of any yarn initially received fully within the wide end sections 28. The ability to properly snag the yarn is greatly enhanced by the full "drop" of the yarn to the bottom of the groove 24, or closely adjacent thereof, provided for by the wide end sections. In this regard, it is intended that the depth of the groove 24 be constant throughout the length of the groove. Further, as will be appreciated by the cross-sectional detail of FIG. 7, it is also contemplated that the cross-section of groove 24, throughout the length thereof, be substantially V-shaped with the opposed walls tapering for the full, or substantially the full height of the groove to an inner end 32. If so desired, in certain instances the inward tapering of the opposed groove walls can terminate just short of line contact to provide a flat base at the inner end of the groove 24. However, even in such circumstances, the constant tapering of the walls is extended for substantially the full height of the groove.

The provision of a constantly varying width and a fixed depth of the groove 24, in conjunction with a continuously tapering groove cross-section, insures proper gripping of any yarn which is capable of dropping or being received within the wider end sections 30. It will, of course, be recognized that other than for the widest or heaviest denier yarn capable of being received within the widest end sections 30, the groove 24 will actually provide an elongated area, any point along which the yarn might be received and subsequently effectively gripped or snagged. In other words, assuming the yarn is of a thickness which can be accommodated within a groove width comparable to that occurring between the narrowest and widest points of the groove 24, such yarn could "drop" into the groove 24 at any point along the groove length wherein the groove itself is of a greater width than the yarn. The thinnest of yarns will, of course, be accommodated within the groove along a major portion of the length of the groove, outward to each side of the narrowest point 26, for ultimate gripping engagement at or immediately adjacent such point 26.

Figure 8:
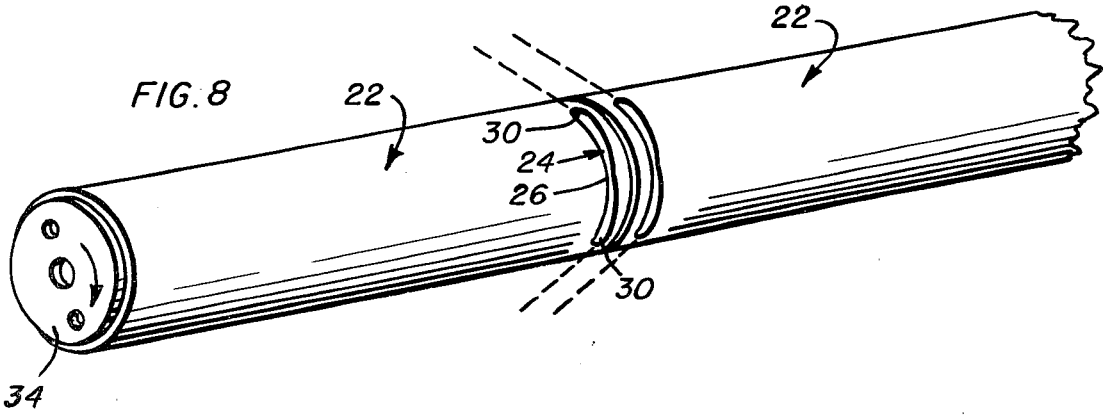
FIG. 8 is a view similar to FIG. 1 with the tubes of the present invention mounted on the spindle.

The particular significance of the specifically configured groove 24 of the present invention will be appreciated from FIG. 8 wherein two tubes 22, formed in accordance with the present invention, are mounted on a clockwise rotating spindle 34, thus approximating the installation assembly of FIG. 1. However, the tubes 22 are duplicates of each other and require no particular order of installation on the spindle 34 in that the pickup grooves 24, in each instance automatically provide for right and left hand pickup as required.

Figure 4:
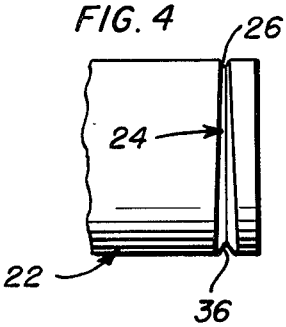
FIG. 4 illustrates one end of a tube wherein the groove is continuous about the tube.
Figure 5:
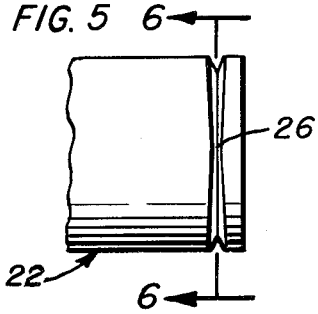
FIG. 5 is a view similar to FIG. 4 with the tube rotated 90°.
Figure 6:
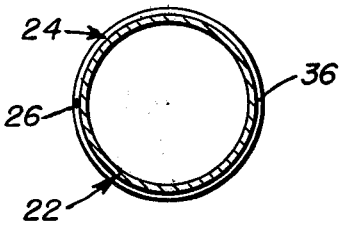
FIG. 6 is a cross-sectional view, taken substantially on line 6—6 in FIG. 5.

As a variation, and without affecting the pickup capability of the groove 24, the opposed maximum width end sections 30 may in fact join at a common maximum width point 36, diametrically opposed from the minimum width point 26, the groove 24 thus completely encircling the tube 11. Such a variation has been illustrated in FIGS. 4, 5 and 6.

It should also be appreciated that while the groove 24 has been illustrated as occurring adjacent one end of the tube 22, depending upon the particular nature of the yarn winding equipment and/or tubes used, the groove 24 may be positioned at any desired or required location along the length of the tube. Incidentally, it is also to be appreciated that while the tube described and illustrated is of a cylindrical configuration, it is intended that the word tube, as used herein, encompass all forms of yarn winding cores or bodies, including bobbins, cones, and the like.

From the foregoing, it will be appreciated that a significant advance in the art has been defined. Basically, the present invention proposed various features which, individually and in combination, provide a yarn pickup system not only able to accommodate both right hand and left hand yarn pickup, but which also uniquely provides for the accommodation of an extremely wide denier range. The means by which these particular advantages are derived include the utilization of both left hand and right hand drop-in areas in conjunction with a common central snagging area, the groove being of a constant progressively varying width inwardly from the widest end drop-in areas to the narrowest central snagging or gripping area. The actual gripping function is performed at any point at which the introduced yarn encounters a groove width less than the width of the yarn itself. This feature will tend to reduce excess travel of the yarn within the gripping groove and result in a more rapid engagement of the groove received yarn.

The foregoing is illustrative of the principles of the invention. As other variations and embodiments may occur to those skilled in the art, it is to be appreciated that it is not desired to limit the invention to the exact construction and manner of use shown and described. Rather, all suitable modifications and variations may be resorted to, falling within the scope of invention as claimed.

I claim:

1. A yarn tube specifically adapted for rotation in opposed directions and yarn pickup in each opposed direction of rotation; said tube being elongated and having an outer yarn receiving surface, a pickup groove in said tube transverse to the length thereof and through said outer surface, said groove extending continuously about at least a substantial portion of the circumstance of the tube and having enlarged end sections, said groove further including a center section between and common to said end sections, said end sections each being of a greater width than said center section, the width of each groove end section increasing outward from the center section, thereby defining maximum width drop-in areas at the end sections of the groove in conjunction with a central narrow width gripping area for the gripping accommodation of the yarn moving inwardly, in either of the opposed directions of rotation, from either wide drop-in area to the narrow gripping area.

2. The yarn tube of claim 1 wherein the width of each end section of the groove, from the center section, varies constantly from a minimum width at the center section to a maximum width remote from the center section.

3. The yarn tube of claim 2 wherein said groove is of a constant depth throughout the length thereof.

4. The yarn tube of claim 3 wherein said groove, in transverse cross-section, is of a substantially V-shaped configuration.

5. The yarn tube of claim 4 wherein said groove end sections meet at a common point, generally diametrically opposed from said common center section, to define a continuous circumferential groove.

6. The yarn tube of claim 3 wherein said groove end sections meet at a common point, generally diametrically opposed from said common center section, to define a continuous circumferential groove.

7. A yarn tube specifically adapted for rotation in opposed directions and yarn pickup in each opposed direction of rotation; said tube being elongated between first and second ends and having an outer yarn receiving surface, a pickup groove in said tube through said outer surface, said groove extending continuously about at least a substantial portion of the circumference of the tube, said groove including a narrow central yarn gripping section, said tube further including a pair of yarn drop-in sections communicating with said gripping section for the introduction of yarn to said gripping section in both directions of rotation of said yarn tube.

* * * * *